US007059397B2

(12) United States Patent
Chatel et al.

(10) Patent No.: US 7,059,397 B2
(45) Date of Patent: Jun. 13, 2006

(54) HEAT EXCHANGER WITH BRAZED PLATES

(75) Inventors: Fabienne Chatel, Chicago, IL (US); Gilles Lebain, Thiais (FR); Claire Szulman, Meudon (FR); Etienne Werlen, Paris (FR)

(73) Assignee: L'Air Liquide, Societe Anonyme A Directoire et Conseil de Surveillance Pour l'Etude et l'Exploitation des Procedes Georges Claude, Paris (FR)

( * ) Notice: Subject to any disclaimer, the term of this patent is extended or adjusted under 35 U.S.C. 154(b) by 135 days.

(21) Appl. No.: 10/250,434

(22) PCT Filed: Dec. 21, 2001

(86) PCT No.: PCT/FR01/04141

§ 371 (c)(1),
(2), (4) Date: Feb. 18, 2004

(87) PCT Pub. No.: WO02/054000

PCT Pub. Date: Jul. 11, 2002

(65) Prior Publication Data

US 2004/0144525 A1 Jul. 29, 2004

(30) Foreign Application Priority Data

Dec. 28, 2000 (FR) ..... 00 17178

(51) Int. Cl.
*F28F 3/02* (2006.01)

(52) U.S. Cl. ..... 165/166; 165/164

(58) Field of Classification Search ..... 165/164, 165/166, DIG. 505

See application file for complete search history.

(56) References Cited

U.S. PATENT DOCUMENTS

| | | | | |
|---|---|---|---|---|
| 3,016,921 | A | 1/1962 | Tadewald | |
| 3,451,473 | A * | 6/1969 | Urie et al. | 165/166 |
| 3,495,656 | A * | 2/1970 | Dickson | 165/166 |
| 4,170,122 | A * | 10/1979 | Cowell | 72/186 |
| 4,246,963 | A * | 1/1981 | Anderson | 165/166 |
| 4,558,735 | A * | 12/1985 | Meike | 165/131 |
| 5,636,685 | A | 6/1997 | Gawve et al. | |
| RE35,890 | E * | 9/1998 | So | 165/109.1 |
| 6,247,523 | B1 * | 6/2001 | Shibagaki et al. | 165/166 |
| 6,729,388 | B1 * | 5/2004 | Emrich et al. | 165/166 |

FOREIGN PATENT DOCUMENTS

| | | |
|---|---|---|
| DE | 32 27 146 | 1/1984 |
| DE | 91 01 494 | 5/1991 |
| EP | 0 106 262 | 4/1984 |

OTHER PUBLICATIONS

International Search Report for PCT/FR01/04141.

* cited by examiner

*Primary Examiner*—Teresa J. Walberg
(74) *Attorney, Agent, or Firm*—Linda K. Russell

(57) ABSTRACT

The invention concerns a heat exchanger which includes a stack of plates defining passages, containing corrugated fins which include a transverse section with repeated corrugated pattern extending between two upper and lower end planes. The pattern includes a base corrugated pattern that includes corrugated legs linked to corrugated summits and corrugated bases, this base pattern being modified by a sub-pattern which defines, between at least some corrugated legs, additional leading edges located at an intermediate level between the end planes. The invention is applicable to cryogenic gas—gas heat exchangers.

21 Claims, 4 Drawing Sheets

HEAT EXCHANGER WITH BRAZED PLATES

BACKGROUND

The present invention relates to a brazed-plate heat exchanger, whose passages contain at least one corrugated fin of the type comprising, in cross section, a repeated corrugated pattern which extends between two upper and lower extreme planes defined by the plates of the exchanger.

The invention is in particular applicable to gas—gas cryogenic exchangers for air distillation apparatuses, such as the main heat exchange line of these apparatuses, which cools the incoming air by indirect heat exchange with the cold products from the distillation column.

The corrugated fins in question are widely used in brazed-plate heat exchangers, which have the advantage of offering a large heat exchange surface area in a relatively small volume, and of being easy to manufacture. In these exchangers, the fluid flows may be cocurrent, countercurrent or crosscurrent flows.

FIG. 1 of the appended drawings shows, in perspective, with partial cutaways, an example of such a heat exchanger, of conventional structure, to which the invention is applicable. In particular, it may involve a cryogenic heat exchanger.

The heat exchanger 1 shown consists of a stack of parallel rectangular plates 2 which are all identical and which between them define a plurality of passages for fluids to be brought into indirect heat exchange relationships. In the example shown, these passages are, in succession and cyclically, passages 3 for a first fluid, 4 for a second fluid and 5 for a third fluid.

Each passage 3 to 5 is bordered by closure bars 6 which define the passage, leaving inlet/outlet windows 7 of the corresponding fluid free. Placed in each passage are spacer waves or corrugated fins 8 acting both as thermal fins, as spacers between the plates, especially during brazing and in order to avoid any deformation of the plates when using pressurized fluids, and for guiding the fluid flows.

The stack of plates, closure bars and spacer waves is generally made of aluminum or aluminum alloy and is assembled in a single operation by furnace brazing.

Fluid inlet/outlet boxes 9, of semicylindrical overall shape, are then welded to the exchanger body thus produced so as to sit over the rows of corresponding inlet/outlet windows, these boxes being connected to fluid feed and discharge pipes 10.

There are various types of spacer waves 8. Thus mention may be made of straight fins, with rectilinear, possibly perforated, generatrices, fins known as "herringbone" fins, with sinuous generatrices, louvered fins, the wave legs of which have rows of recesses, and partially offset or "serrated" fins.

In these various fins, the wave may have a square, rectangular, triangular, sinusoidal, etc., cross section.

SUMMARY

A brazed-plate heat exchanger apparatus comprising:

(i) a stack of parallel plates wherein said parallel plates define a plurality of generally flat-shaped fluid flow passages;

(ii) closure bars wherein said closure bars define passages; and (iii) corrugated fins wherein said corrugated fins comprise, in cross section, a repeated corrugated pattern extending between two upper and lower extreme planes defined by two adjacent plates of the exchanger, wherein said pattern comprises a basic corrugated pattern-comprising wave legs connected by wave crests and wave troughs and wherein said pattern are modified by a subpattern which comprises additional exchange surfaces located between at least some pairs of wave legs, wherein said additional exchange surfaces are located at an intermediate level between the two extreme planes.

The aim of the invention is to improve the thermal performance of exchanges with corrugated fins. To this end, the subject of the invention is a brazed-plate heat exchanger, of the type comprising a stack of parallel plates which define a plurality of generally flat-shaped fluid flow passages, closure bars which define these passages, and corrugated fins placed in the passages, at least some of the corrugated fins being of the type comprising, in cross section, a repeated corrugated pattern extending between two upper and lower extreme planes defined by two adjacent plates of the exchanger, characterized in that the pattern comprises a basic corrugated pattern comprising wave legs connected by wave crests and wave troughs, this basic pattern being modified by a subpattern which defines, between at least some pairs of wave legs, additional exchange surfaces located at an intermediate level between the two extreme planes.

According to other optional aspects:

- the subpattern defines a subcorrugation which extends only over a portion of the distance which separates the two extreme planes.
- the subpattern comprises at least one nonvertical part located at an intermediate level between the two extreme planes.
- the subpattern further comprises pairs of limbs which connect the nonvertical parts alternately to a wave crest and to a wave trough.
- the limbs are vertical.
- the subpattern comprises at least one additional oblique exchange surface.
- the subpattern has a V-shaped section.
- the subpattern comprises a step adjacent to at least some legs of the main pattern.
- the fin is partially offset.
- the offset distances ensure that the main pattern is offset both with respect to itself and with respect to the subpattern.
- the pattern repeats every N rows of waves, where $N \geqq 3$ and in particular, $N=4$.
- at least some parts of at least some troughs and/or subpatterns comprise a notch in at least one leading and/or trailing edge and in at least part of their height or their width.
- the wave has a square, rectangular, triangular or sinusoidal cross section.
- the basic corrugated pattern is constant over the entire length of the two extreme planes.

The following will mainly concern serrated fins, but it will be understood that the invention is also applicable to other types of fins described above.

Exemplary embodiments of the invention will now be described with respect to the appended drawings, in which:

BRIEF DESCRIPTION OF THE DRAWINGS

For a further understanding of the nature and objects for the present invention, reference should be made to the following detailed description, taken in conjunction with the accompanying drawing, in which like elements are given the same or analogous reference numbers and wherein.

DESCRIPTION OF PREFERRED EMBODIMENTS

A brazed-plate heat exchanger apparatus comprising:

(i) a stack of parallel plates wherein said parallel plates define a plurality of generally flat-shaped fluid flow passages;

(ii) closure bars wherein said closure bars define passages; and (iii) corrugated fins wherein said corrugated fins comprise, in cross section, a repeated corrugated pattern extending between two upper and lower extreme planes defined by two adjacent plates of the exchanger, wherein said pattern comprises a basic corrugated pattern-comprising wave legs connected by wave crests and wave troughs and wherein said pattern are modified by a subpattern which comprises additional exchange surfaces located between at least some pairs of wave legs, wherein said additional exchange surfaces are located at an intermediate level between the two extreme planes.

Figure 1:
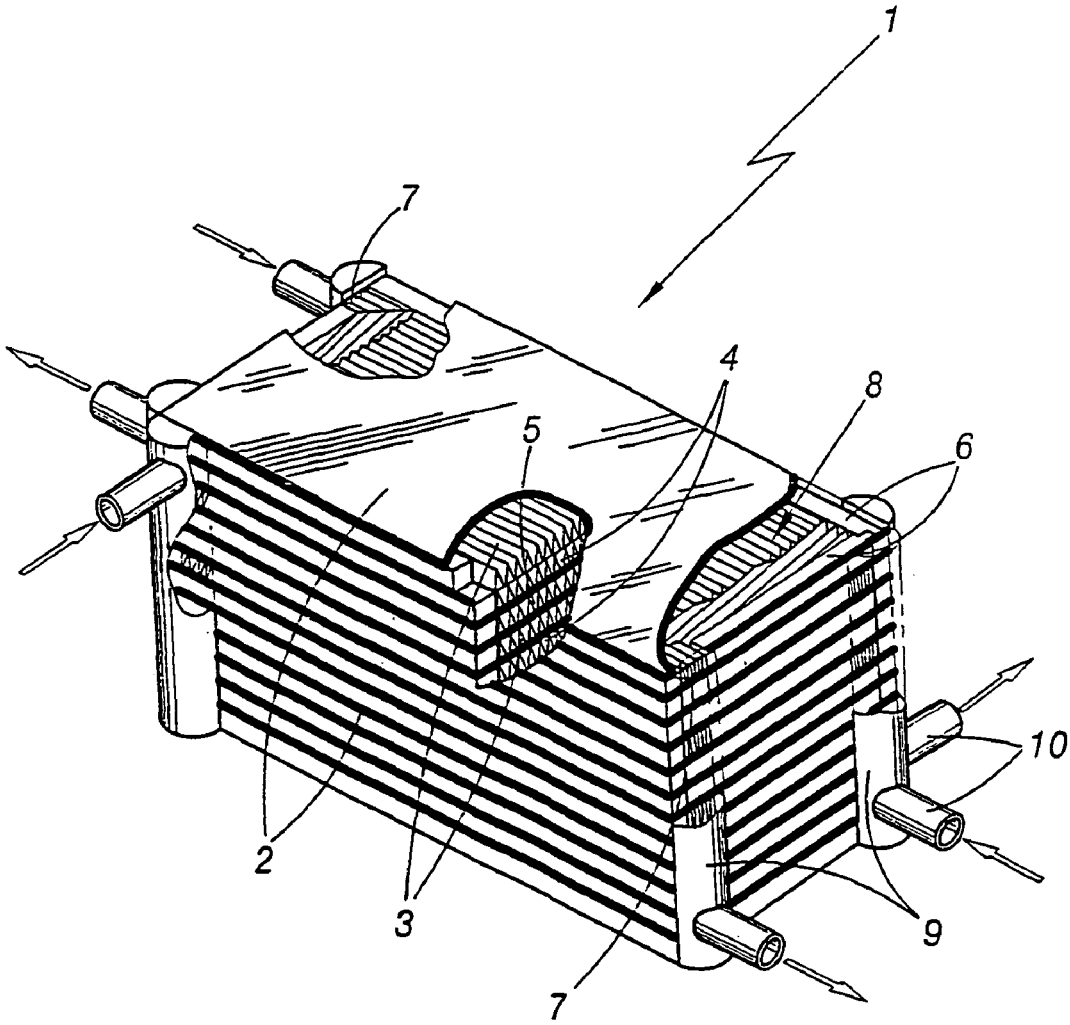
FIG. 1 illustrates a conventional heat exchanger as know in the art.
Figure 2:
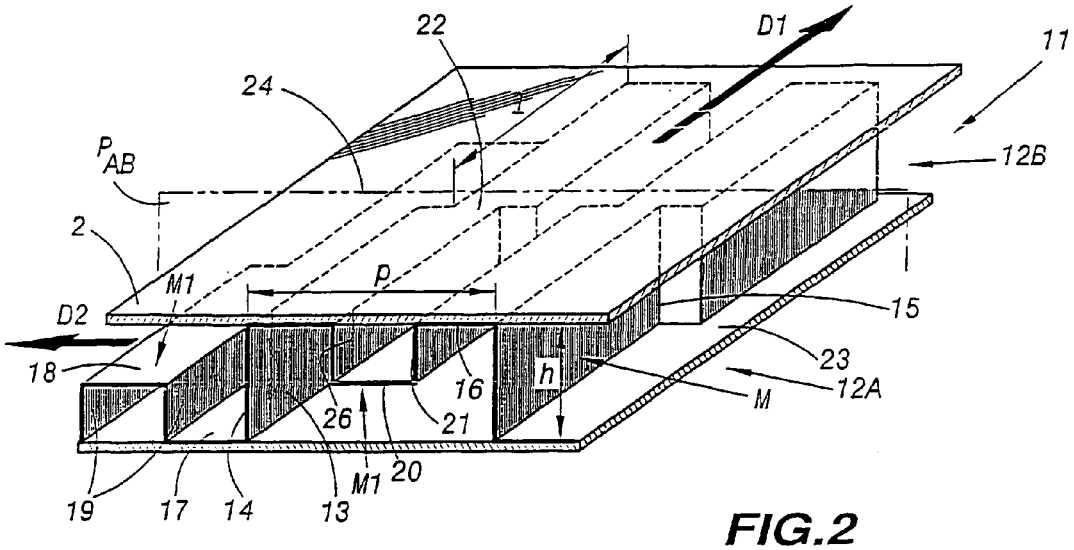
FIG. 2 shows, in perspective, a serrated fin according to the invention.
Figure 3:
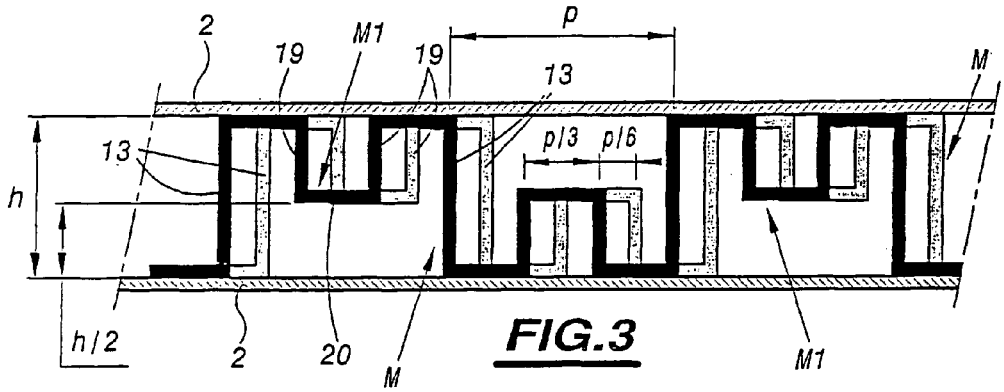
FIG. 3 is an end view of this fin.

The serrated fin 1 shown in FIGS. 2 and 3 has an overall main corrugation direction Dl and comprises a large number of adjacent wave rows 12A, 12B, . . . , which are all identical and are oriented in a direction D2 perpendicular to the direction Dl.

For convenience in the description, it will be assumed that, as shown in FIG. 2, the directions D1 and D2 are horizontal, similarly with the plates 2 of the exchanger.

Each wave row 12 has, in cross section perpendicular to D1, a basic pattern M which comprises two vertical wave legs 13. With respect to an overall sense F of the flow of the fluid along the direction D1 in the passage in question, each leg comprises a leading edge 14 and a trailing edge 15. The legs are alternately connected along their upper edge by means of a rectangular, flat and horizontal wave crest 16, and along their lower edge by means of a wave trough 17 which is also rectangular, flat and horizontal.

The basic pattern M is modified by a subpattern M1 consisting of a rectangular projection extending downward in the middle of each crest 16 and upward in the middle of each trough 17.

Each subpattern M1 consists of one flat end part 18 located half way between the extreme planes defined by the adjacent plates 2, and two vertical limbs 19 which connect the edges thereof to the corresponding crest 16 or trough 17.

Thus, each subpattern forms a notch which comes in between the two adjacent legs 13. This notch defines three additional exchange surfaces, that is a horizontal exchange surface 20 and two vertical exchange surfaces 21.

The rows 12 are offset one with respect to another in the direction D2, alternately in one sense and in the other. By using the term "pitch" to refer to the distance p which separates two successive legs 12 (ignoring the thickness e of the thin sheet material forming the wave), the offset is alternately p/6 in one sense and in the other, while the notch width M1 is p/3.

Thus, each row 12 is connected to the following row 12 by means of the crests 16, along right-handed segments 22 of length p/6, and by means of the troughs 17, along The serrated fin 1 shown in FIGS. 2 and 3 has an overall main corrugation direction Dl and comprises a large number of adjacent wave rows 12A, 12B, . . . , which are all identical and are oriented in a direction D2 perpendicular to the direction Dl. right-handed segments 23 of the same length p/6. The offset planes are the vertical planes such as $P_{AB}$ and the offset lines, seen from the top, are denoted by 24.

Moreover, l is used to denote the length of each row 12 in the direction D1, this length being called the "serration length", and h is used to denote the height of the fin.

In practice, the shapes of various wave parts may differ to a greater or lesser degree from the theoretical shapes described above, especially with regard to the flatness and the rectangular shape of the facets 13 and 16 to 19, and the verticality of the facets 13 and 19.

Seen from the end (FIG. 3), the patterns M are offset sideways with respect to themselves and with respect to the patterns M1, that is to say that the legs 13 of a given serration row 12 each appear between a leg 13 of the adjacent rows and a limb 19 of a neighboring subpattern M1. Conversely, the limbs 19 of the same row 12 each appear either between two limbs 19, or between a limb 19 and a leg 13, of the adjacent rows 12.

Because of the presence of the subpatterns M1, the flow separation is increased at each offset line 24, which increases the temperature difference between the fluid and the fin, thus increasing the heat flux exchanged. The presence of additional leading edges 20 and 21 further generates turbulence within the fluid, which promotes heat transfer by convection toward the core of the flow and not by conduction through the limiting layer, which promotes heat exchange.

Figure 4:
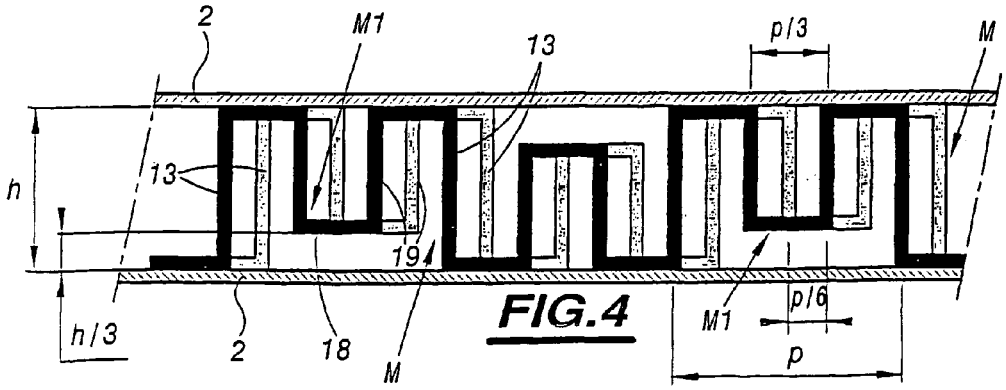
FIG. 4 is an end view of a variant.

The variant of FIG. 4 differs from that of FIG. 3 by a greater depth of the notches M1, this depth changing from about h/2 to 2h/3. In this way, the preferential flow regions, which miss out on the beneficial effect of the notches M1 described above, are reduced.

Figures 5, 6:
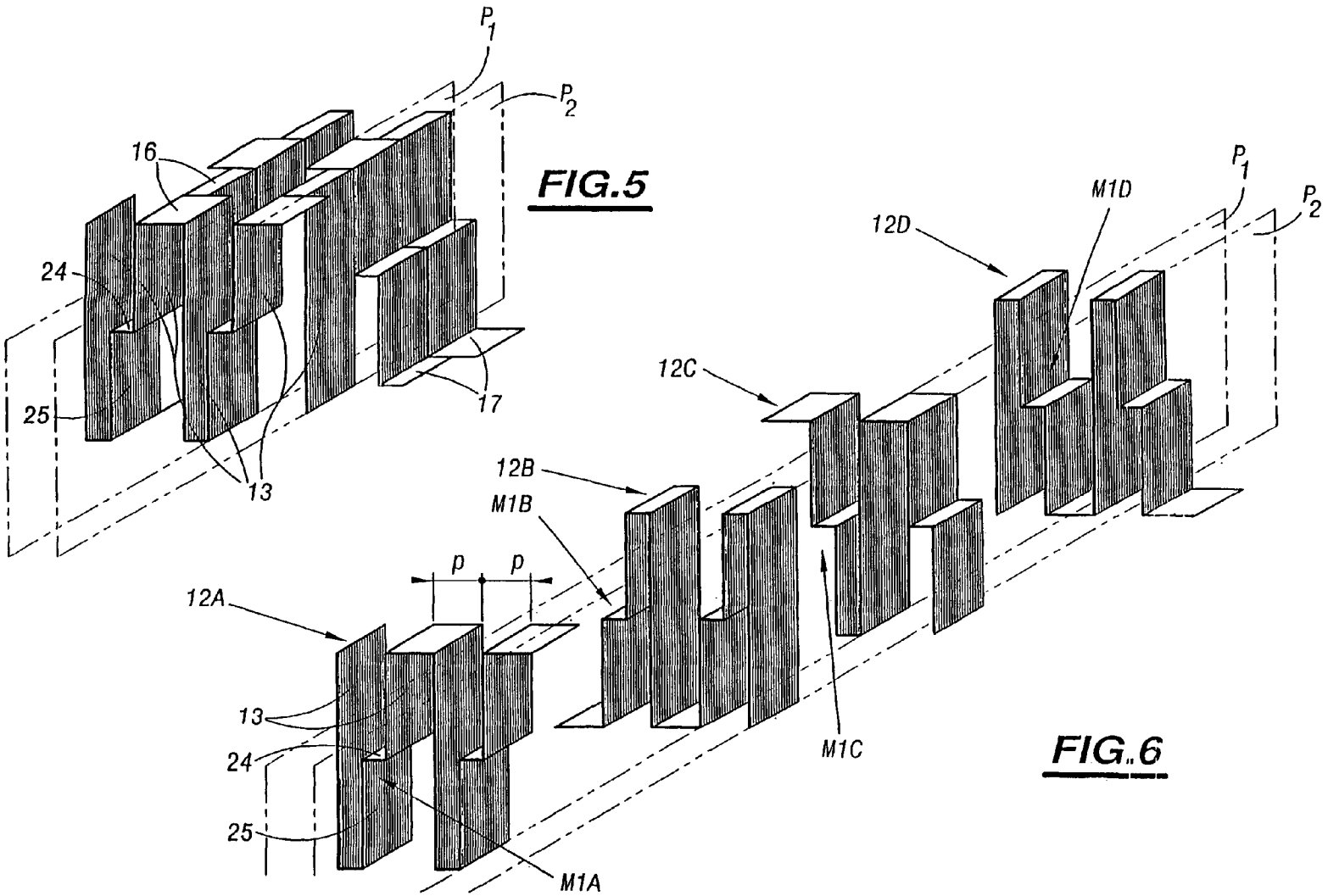
FIG. 5 shows, in perspective, another serrated fin according to the invention.
FIG. 6 is a view in exploded perspective of the fin of FIG. 5.
Figure 7:
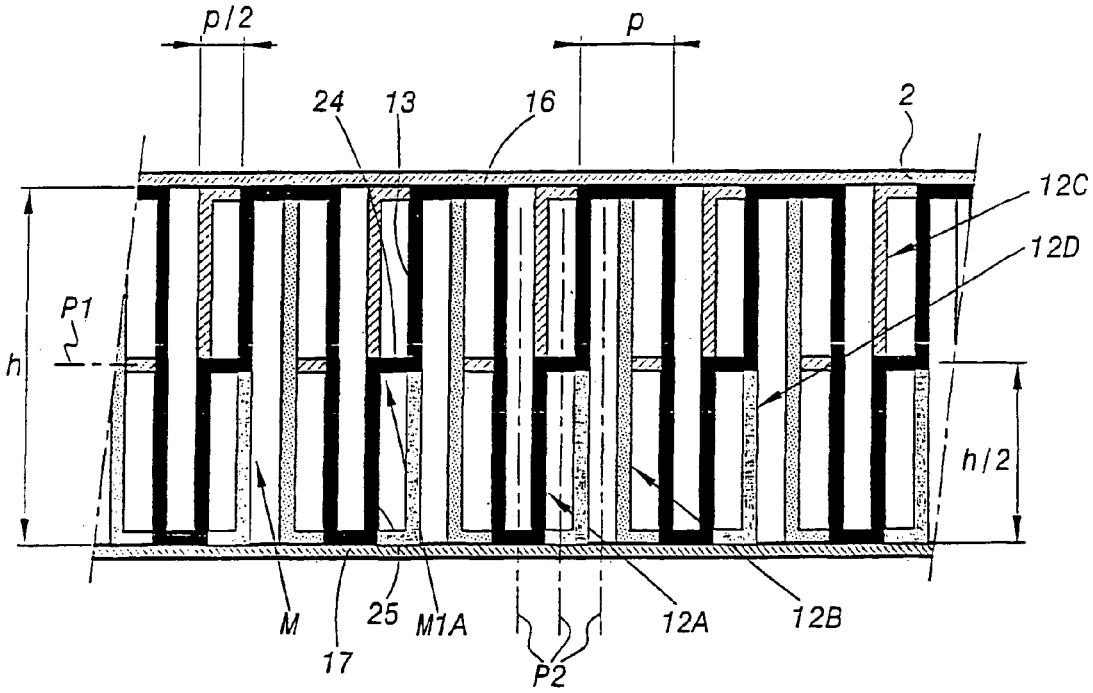
FIG. 7 is an end view of the fin of FIG. 5.

With the same objective, FIGS. 5 to 7 show a serrated fin whose pattern M+M1 repeats not every other row, but one row in N, where $N \geqq 3$. This makes it possible to increase the symmetry of flow. In the example shown, N=4. Four successive rows 12A to 12D will subsequently be described below.

As previously, each row has the same rectangular basic pattern M, comprising vertical legs 13 spaced apart by the pitch p and alternately connected by a wave crest 16 of width p and by a wave trough 17 of the same width p. The pattern M is modified by a subpattern M1A to M1D:

subpattern M1A: in each upwardly open corrugation, the lower part of the right leg 13 is deformed by a step which comprises a horizontal part 24 located half way up the leg and a vertical part 25 located half way between this leg and the other leg of the corrugation. Thus, the lower half of the leg and the right half of the adjacent wave trough are removed, as shown by chain line;

subpattern M1B: in each downwardly open corrugation, the upper part of the left leg 13 is deformed by a similar step, that is to say a rectangular step of dimensions p/2 and h/2;

subpattern M1C: in each upwardly open corrugation, the lower part of the left leg 13 is deformed by a similar step. This subpattern is therefore symmetrical with respect to the subpattern M1A;

subpattern M1D: in each downwardly open corrugation, the upper part of the right leg 13 is deformed by a similar step. This subpattern is therefore symmetrical with respect to the subpattern M1B;

Moreover, in this embodiment, the offset from one row to the next is p/2, alternating in one sense and in the other (?). FIGS. 5 and 6 indicate two neighboring vertical planes P1 and P2, in order to make it easier to understand the structure of the fin.

Figure 8:
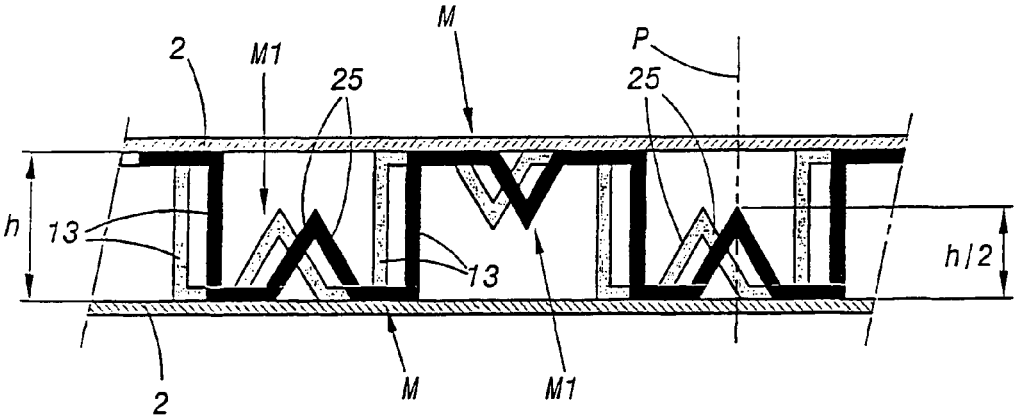
FIG. 8 is an end view of another serrated fin according to the invention.

The embodiment of FIG. 8 is derived from that of FIG. 3 in that each subpattern M1 is triangular and is no longer rectangular or square. Thus two oblique leading edges 25, which are symmetrical with respect to the vertical plane of symmetry P of the wave, are inserted into each wave.

In the example shown, the height of the triangle is h/2, but, as before, it may have a different value, especially a value greater than h/2 in order to reduce the preferential flow regions.

In all the above examples, high thermal performance of the exchanger, with highly divided and turbulent flow and with a two-dimensional, or even three-dimensional configuration is obtained.

Note that the fins may be manufactured by simple folding of a flat product on a press or using a cogged wheel, as for the conventional corrugated, especially serrated, fins. This is because the surfaces are all developable, such that it is enough to match the profile of the folding tools.

The presence of the subpatterns M1 causes passage restriction at the offset lines, and therefore pressure drops. These pressure drops can possibly be reduced by providing notches carefully placed in at least some leading and/or trailing edges of the patterns M and/or M1. These notches will preferably be located facing the leading and/or trailing edges of the subpatterns M1, or therewithin, as indicated in chain line by 26 in FIG. 2.

Whatever the fin type, the latter may be made either from solid sheet metal, or from perforated sheet metal or sheet metal provided otherwise with apertures.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A brazed-plate heat exchanger apparatus comprising:

(i) a stack of parallel plates wherein said parallel plates define a plurality of generally flat-shaped fluid flow passages;

(ii) closure bars wherein said closure bars define passages; and (iii) corrugated fins wherein said corrugated fins comprise, in cross section, a repeated corrugated pattern extending between two upper and lower extreme planes defined by two adjacent plates of the exchanger, wherein said pattern comprises a basic corrugated pattern comprising wave legs connected by wave crests and wave troughs and wherein said pattern are modified by a subpattern which comprises additional exchange surfaces located between at least some pairs of wave legs, wherein said additional exchange surfaces are located at an intermediate level between the two extreme planes.

2. The apparatus according to claim 1, wherein said subpattern comprises a subcorrugation that extends only over a portion of the distance which separates the two extreme planes.

3. apparatus according to claim 1, wherein said subpattern comprises at least one nonvertical part located at an intermediate level between the two extreme planes.

4. The apparatus according to claim 2, wherein said subpattern comprises at least one nonvertical part located at an intermediate level between the two extreme planes.

5. The apparatus according to claim 3, wherein said subpattern further comprises pairs of limbs which connect the nonvertical parts alternately to a wave crest and to a wave trough.

6. The apparatus according to claim 5, wherein said limbs are vertical.

7. Then apparatus according to claim 1, wherein said subpattern comprises at least one additional oblique exchange surface.

8. The apparatus according to claim 2, wherein said subpattern comprises at least one additional oblique exchange surface.

9. The apparatus according to claim 7, wherein said subpattern has a V-shaped section.

10. The apparatus according to claim 1, wherein said subpattern comprises a step adjacent to at least some legs of the main pattern.

11. The apparatus according to claim 2, wherein said subpattern comprises a step adjacent to at least some legs of the main pattern.

12. The apparatus according to claim 1, wherein a fin is partially offset.

13. The apparatus according to claim 7, wherein a fin is partially offset.

14. The apparatus according to claim 10, wherein a fin is partially offset.

15. The apparatus according to claim 12, wherein the offset distances ensure that the main pattern is offset both with respect to itself and with respect to the subpattern.

16. The apparatus according to claim 15, wherein the pattern repeats every N rows of waves, wherein said N is at least about 3.

17. The apparatus according to claim 16, wherein said N is equal to about 4.

18. The apparatus according to claim 1, wherein some parts of at least some troughs and/or subpatterns comprise a notch in at least one leading and/or trailing edge and in at least part of their height or their width.

19. The apparatus according to claim 9, wherein some parts of at least some troughs and/or subpatterns comprise a notch in at least one leading and/or trailing edge and in at least part of their height or their width.

20. apparatus according to claim 17, wherein some parts of at least some troughs and/or subpatterns comprise a notch in at least one leading and/or trailing edge and in at least part of their height or their width.

21. The apparatus according to claim 1, wherein said wave comprises of a square, rectangular, triangular or sinusoidal cross section.

* * * * *

UNITED STATES PATENT AND TRADEMARK OFFICE

CERTIFICATE OF CORRECTION

PATENT NO. : 7,059,397 B2
APPLICATION NO. : 10/250434
DATED : June 13, 2006
INVENTOR(S) : Chatel et al.

It is certified that error appears in the above-identified patent and that said Letters Patent is hereby corrected as shown below:

In column 6, Claim 3, line 10, please insert the word --The-- before the word "apparatus" .

In column 6, Claim 7, line 22, please replace the word "Then" with the word --The-- .

In column 6, Claim 20, line 59, please insert the word --The-- before the word "apparatus" .

Signed and Sealed this

Tenth Day of October, 2006

JON W. DUDAS
*Director of the United States Patent and Trademark Office*